United States Patent [19]

Raudat

[11] 4,446,672

[45] May 8, 1984

[54] METHOD FOR DROP PACKING SMALL UNSTABLE ARTICLES

[75] Inventor: John L. Raudat, North Madison, Conn.

[73] Assignee: Standard-Knapp, Inc., Portland, Conn.

[21] Appl. No.: 298,062

[22] Filed: Aug. 31, 1981

[51] Int. Cl.[3] ..... B65B 35/32; B65B 35/44

[52] U.S. Cl. ..... 53/448; 53/475; 53/534; 53/246; 53/247

[58] Field of Search ..... 53/245, 246, 248, 247, 53/534, 255, 261, 443, 448, 475

[56] References Cited

U.S. PATENT DOCUMENTS

| | | | |
|---|---|---|---|
| 2,746,662 | 5/1956 | Thompson et al. | 53/534 X |
| 3,116,579 | 1/1964 | Carter | 53/248 X |
| 3,193,980 | 7/1965 | Mumma | 53/534 X |
| 3,353,331 | 11/1967 | Rowenkamp | 53/249 X |
| 3,492,779 | 2/1970 | Russell | 53/245 X |
| 3,525,195 | 8/1970 | Mosterd | 53/534 |
| 3,964,233 | 6/1976 | Thomas | 53/534 X |
| 4,316,762 | 2/1982 | Martin | 53/248 X |

*Primary Examiner*—Horace M. Culver
*Attorney, Agent, or Firm*—McCormick, Paulding & Huber

[57] ABSTRACT

Small glass bottles of unstable configuration are drop packed in several stages to fill a packing case capable of holding a relatively large number of such bottles. Separate slugs of articles are formed to fill predetermined portions of the case in a method which permits use of a conventional drop packer grid.

3 Claims, 9 Drawing Figures

FIG. IA

METHOD FOR DROP PACKING SMALL UNSTABLE ARTICLES

This invention relates generally to drop packing relatively small unstable articles such as wine bottles of peculiar shape used either as give aways or for individual servings, and deals more particularly with a method for the operation of a drop packer which is peculiarly well suited to packing of large numbers of such articles in cases.

In carrying out the method of the present invention articles are fed in side-by-side columns between lane guides such that the articles or bottles are advanced in end-to-end relationship in each of the lanes on an infeed conveyor where line pressure is adapted to move them across a deadplate and into a grid structure of the type generally used with conventional drop packers. Conventional means is provided for interrupting the flow of articles so fed after a predetermined number of the articles have entered the grid. This number of articles is chosen so that the relatively unstable articles do not tend to become tilted out of their vertical orientation as they enter the grid and the charge so formed will be less than that required to fill the case. This charge of articles is dropped through a conventional funnel into a portion of the case, whereupon the case is moved to provide another portion below the funnel. The articles are again allowed to flow into the grid to form a second charge subsequently dropped into the case to fill said additional portion thereof.

FIG. 1A is a sectional view taken along the line 1A—1A of FIG. 1.

Figure 1:
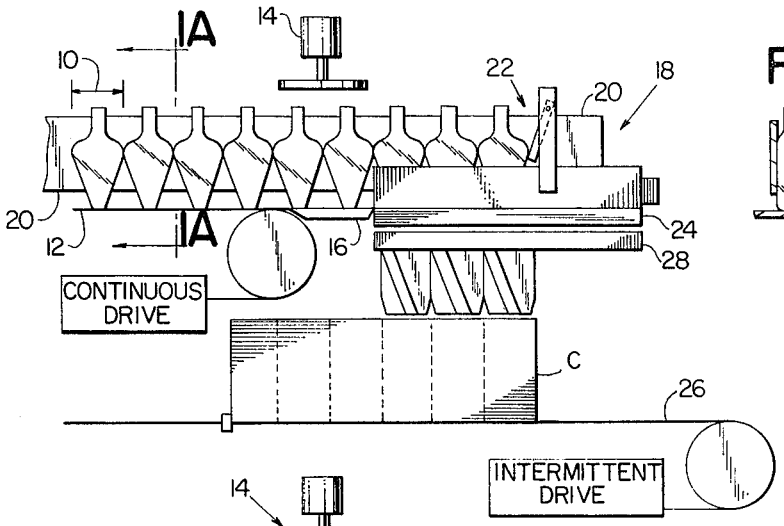
FIG. 1 is a schematic view of a drop packing grid equipped to fill cases in accordance with the method of the present invention.
Figure 2:
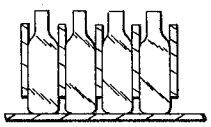
FIG. 2 is a view similar to FIG. 1 but taken at a slightly later instant of time.
Figure 2:
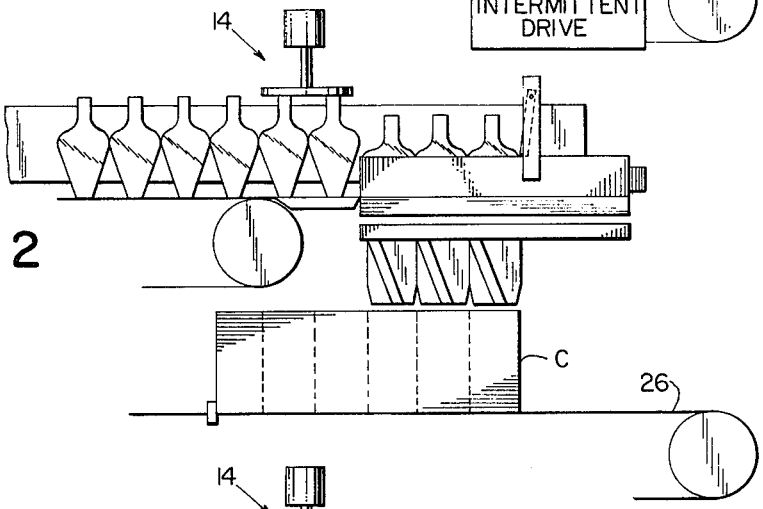
Figure 3:
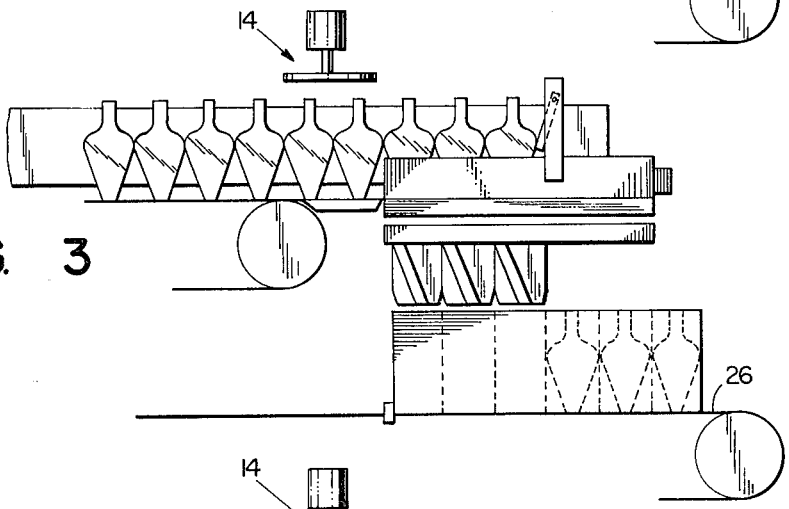
FIG. 3 is a view similar to FIGS. 1 and 2 but at a still later instant of time.
Figure 4:
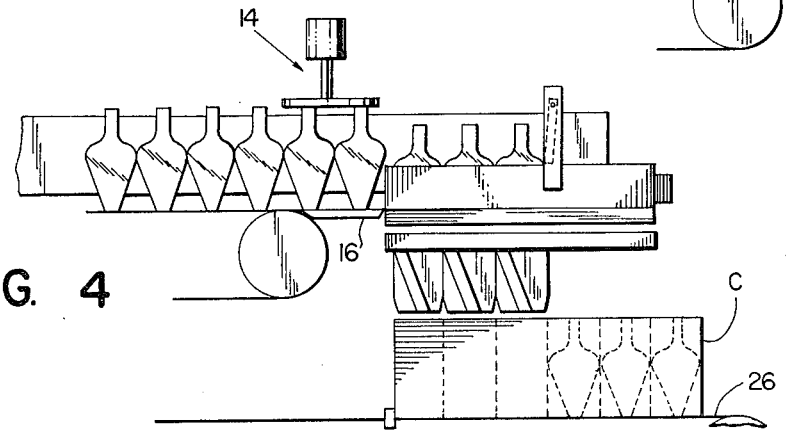
FIG. 4 is a view similar to FIGS. 1, 2 and 3 taken at a point near the end of the cycle of operation for the drop packer of FIG. 1.

Turning now to the drawings in greater detail, and referring particularly to FIGS. 1 and 1A, the unstable articles to be packed are shown as comprising relatively narrow glass containers having a shoulder width 10 considerably larger than the width of the base. It will be apparent that as such articles are fed along infeed conveyor 12 they can tend to become cocked or tilted with respect to one another especially as their progress is interrupted by the line brake 14 which serves to clamp two of the articles against a deadplate 16 provided between the downstream end of the infeed conveyor 12 and a drop packer grid 18. The packer grid 18 comprises a continuation of the lane guides 20 between which the articles are fed by line pressure from the infeed conveyor 12, and lane detection means 22 is provided for indicating when a charge of desired size has been formed in the upper portion of the grid 18. Laterally shiftable riding strips 24 are provided in the lower portion of the lane defining area of the grid 18 and the articles are fed across the upper edges of these riding strips 24 until the grid is filled, at which time the brake 14 clamps the articles on the deadplate as best shown in FIG. 2. The riding strips 24 are then shifted laterally to allow the charge to drop downwardly into the packing case C located therebelow. The packing case C is itself provided on a conveyor 26 and the grid structure 18 includes a funnel assembly 28 in accordance with conventional practice.

In the apparatus of FIGS. 1–4 the infeed conveyor 12 is continuously driven so that it moves beneath the articles held back by the line brake 14 in the configuration shown in FIG. 2. The case conveyor 26 is intermittently driven so that the case C is moved from the FIG. 1 position to the FIG. 3 position in timed relationship with actuation of other components of the drop packer. More particularly, once the charge of twelve bottles has been dropped as suggested in FIG. 2 into a front portion of the case C, conveyor 26 will advance the case from the FIG. 2 position to that illustrated in FIG. 3. At the same time the line brake 14 releases the articles for forming a second charge. Once the second charge has been formed the line brake again engages the articles over the deadplate 16 so that this second charge can be dropped onto another portion of the case C as suggested in FIG. 4.

Figure 5:
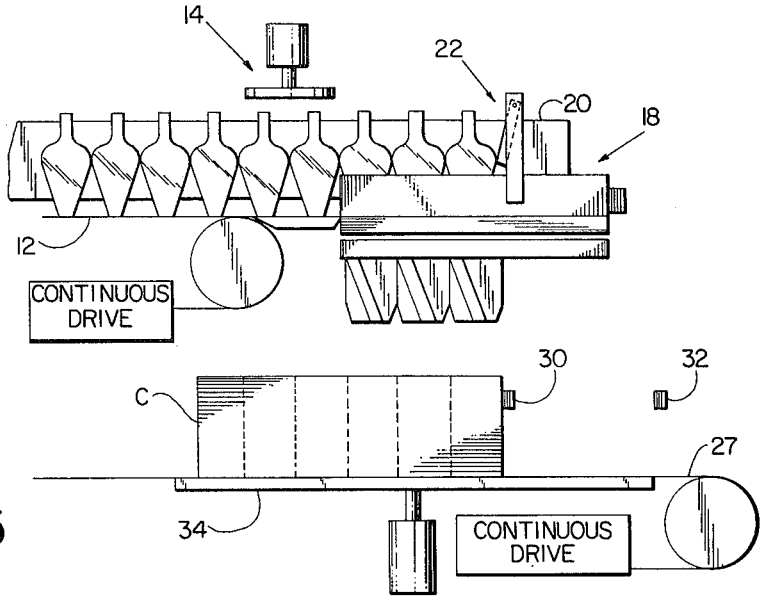
FIG. 5 is a schematic view of an alternative form of apparatus capable of accomplishing the method of the present invention.
Figure 6:
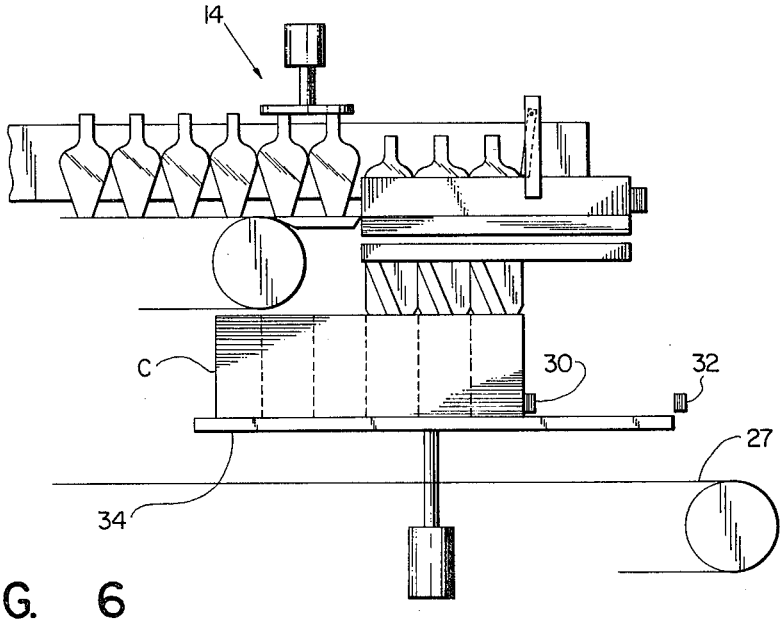
FIG. 6 is a view similar to FIG. 5 but taken at a slightly later instant of time.
Figure 7:
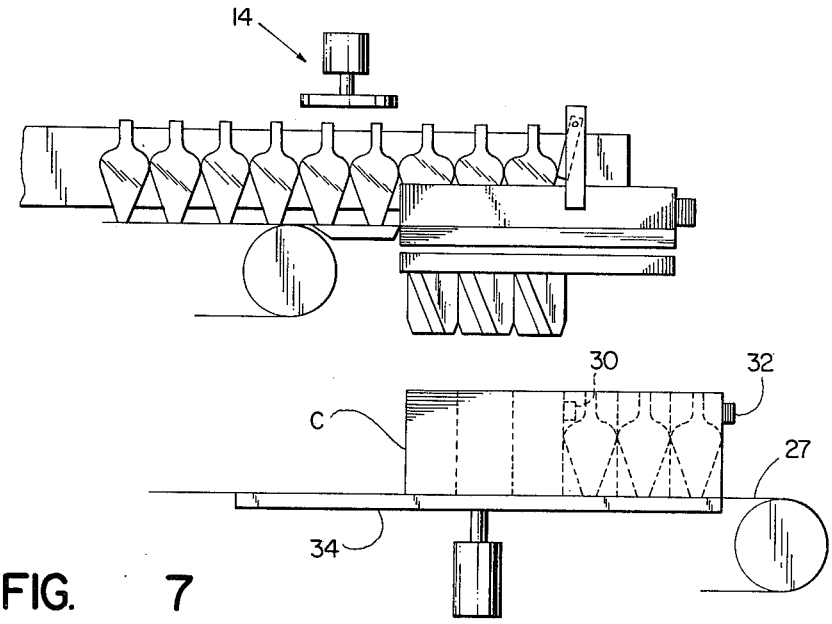
FIG. 7 is a view similar to FIGS. 5 and 6 but at a still later instant of time.
Figure 8:
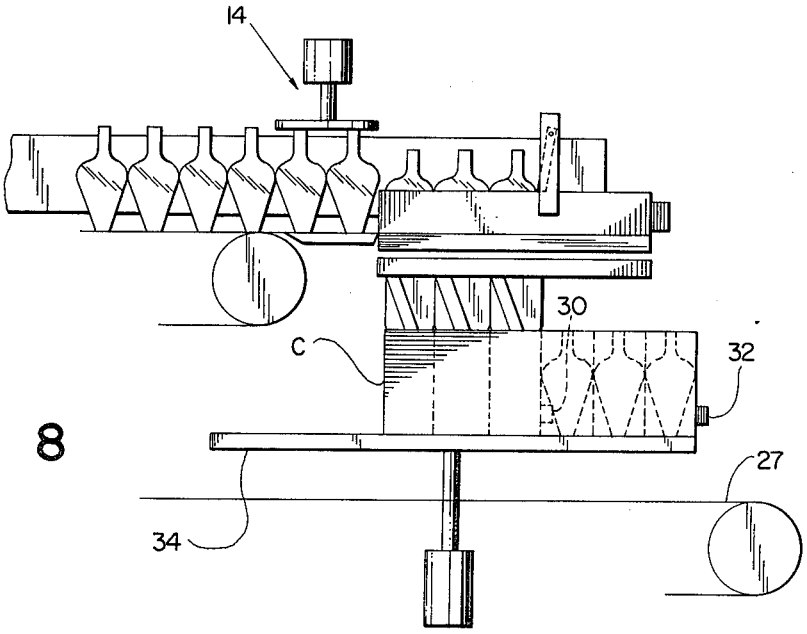
FIG. 8 is a view similar to FIGS. 5, 6 and 7 taken at a point near the end of the cycle of operation for the drop packer of FIG. 5.

In the apparatus of FIGS. 5–8 the case conveyor 27 is continuously driven and retractable stops 30 and 32 serve to interrupt movement of the case conveyor as required to stop the case at the FIG. 5 and FIG. 7 positions respectively. A lift table 34 is adapted to move up through gaps in the case conveyor 27 to raise the case up into the funnel as shown in FIGS. 6 and 8. The successive charges of articles for deposit in the case are formed in the same manner as described above with reference to FIGS. 1–4, and similar parts of the packer carry identical reference numerals in both the apparatus of FIGS. 1–4 and FIGS. 5–8.

I claim:

1. A method for drop packing unstable articles into upwardly open packing cases and comprising the steps of:

(a) feeding the articles on a conveyor in end-to-end relationship and in side-by-side columns to fill a drop packer grid of the type having side-by-side lanes for receiving the columns of articles at the downstream end of the conveyor whereby a charge of articles is provided in the grid, adjacent the downstream end of the conveyor, (b) stopping the flow of articles on the conveyor after a predetermined number of articles have entered the grid whereby the charge of articles in the grid are segregated from those being fed toward the grid on the conveyor, (c) mating a portion of the case with a funnel and dropping the charge of articles through the funnel so that only that portion of the case is filled by the charge, and continuing to hold back the flow of articles on the conveyor, (d) moving the case so that another portion is positioned below the grid to receive another charge, and mating that portion with the funnel, (e) allowing the articles to again flow into the grid to form a second charge, (f) dropping the second charge through the funnel and into the case to fill said another portion thereof.

2. The method of claim 1 further characterized by the steps of lifting the case upwardly to mate with the funnel prior to dropping the charges of articles into the portions of the case.

3. The method of claim 2 wherein the case is lowered onto a conveyor for movement into position to receive the second charge of articles and prior to said lifting step for mating the case with the funnel for dropping the second charge.

* * * * *